US008277228B2

(12) United States Patent
Miyazaki et al.

(10) Patent No.: US 8,277,228 B2
(45) Date of Patent: Oct. 2, 2012

(54) CONNECTOR SET AND JOINTER FOR USE THEREIN

(75) Inventors: Youji Miyazaki, Kadoma (JP); Kenji Ookura, Kadoma (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 0 days.

(21) Appl. No.: 13/230,389

(22) Filed: Sep. 12, 2011

(65) Prior Publication Data

US 2012/0003859 A1 Jan. 5, 2012

Related U.S. Application Data

(63) Continuation of application No. 12/786,728, filed on May 25, 2010, now Pat. No. 8,029,294.

(30) Foreign Application Priority Data

May 26, 2009 (JP) ..... 2009-126553

(51) Int. Cl.
*H01R 13/44* (2006.01)

(52) U.S. Cl. ..... 439/41

(58) Field of Classification Search ..... 439/41, 439/940, 135, 74, 630, 78, 449
See application file for complete search history.

(56) References Cited

U.S. PATENT DOCUMENTS

| | | | | |
|---|---|---|---|---|
| 5,641,291 | A | 6/1997 | Sueki et al. | |
| 6,095,832 | A | 8/2000 | Kusuhara et al. | |
| 6,619,965 | B1 | 9/2003 | Kihira et al. | |
| 6,623,308 | B2 | 9/2003 | Ono | |
| 2002/0137396 | A1 | 9/2002 | Ono | |
| 2004/0014335 | A1 | 1/2004 | Igarashi et al. | |
| 2005/0009383 | A1 | 1/2005 | Okura et al. | |
| 2007/0105408 | A1 | 5/2007 | Ookura | |
| 2008/0153330 | A1* | 6/2008 | Minich | 439/135 |
| 2009/0053909 | A1* | 2/2009 | Lin et al. | 439/66 |

FOREIGN PATENT DOCUMENTS

| | | |
|---|---|---|
| JP | 5-31188 | 4/1993 |
| JP | 08-250236 | 9/1996 |
| JP | 8-250836 | 9/1996 |
| JP | 9-153384 | 6/1997 |
| JP | 11-3752 | 1/1999 |
| JP | 2002-8753 | 1/2002 |
| JP | 2005-294036 | 10/2005 |

* cited by examiner

*Primary Examiner* — Alexander Gilman

(74) *Attorney, Agent, or Firm* — Drinker Biddle & Reath LLP

(57) ABSTRACT

A connector set includes at least one of a header and a socket and a jointer. The jointer extends in a direction and is configured to couple the header and the socket so as to be in parallel with each other. The jointer includes first jointer connecting portions provided at both end portions thereof and extending in a second direction perpendicular to the first direction, and which are configured to engage first connecting portions provided at both end portions of the header, and second jointer connecting portions provided at both end portions of the jointer body and extending in a third direction opposite to the second direction, and which are configured to engage the second connecting portions provided at both end portions of the socket.

14 Claims, 13 Drawing Sheets

FIG. 3
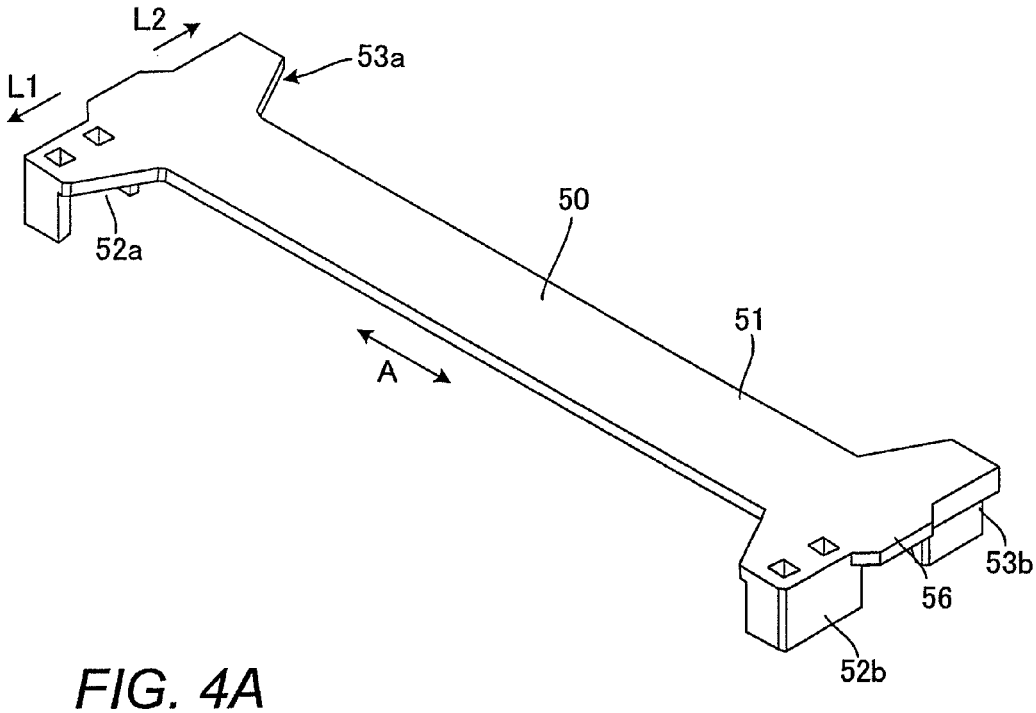
FIG. 4A
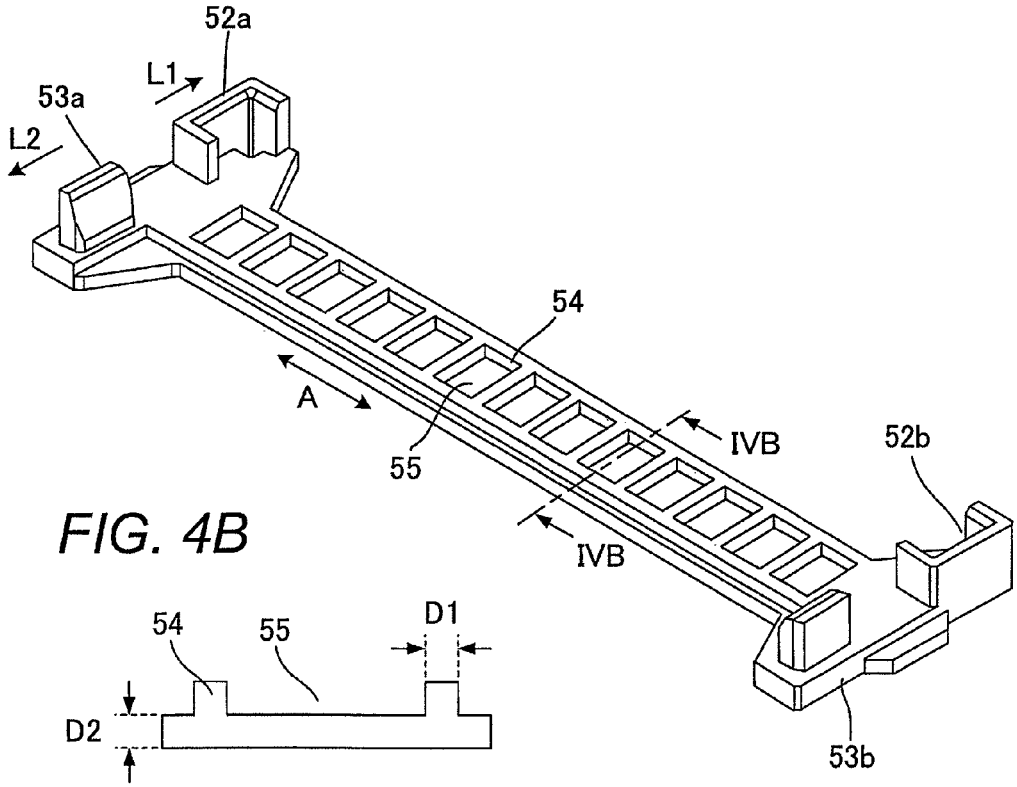
FIG. 4B

CONNECTOR SET AND JOINTER FOR USE THEREIN

This is a continuation application of copending application Ser. No. 12/786,728, filed on May 25, 2010, which is incorporated by reference herein in its entirety.

BACKGROUND OF THE INVENTION

1. Technical Field

The present invention relates to a connector set and a jointer for use therein and, more particularly, to a structure of a jointer for joining a plurality of connectors.

2. Description of Related Art

Size reduction and functional upgrade of a portable terminal, such as a portable phone, are recently proceeding, and miniaturization and integration of electronic components to be mounted as well as size reduction of a printed wiring board are also becoming greater. Under such a circumstance, devices requiring ultra-multi-conductor connectors having 200 conductors have come out in relation to connectors. A pitch eventually becomes finer, and a footprint that can be used for mounting a connector becomes further smaller. Even a slight size reduction is increasingly becoming serious.

Various connectors for a variety of applications have hitherto been put forward. As shown in FIG. 16, there is an example of a connector including a socket 1010 and a header 1030, and the connector makes an electrical connection between printed wiring boards (e.g., an FPC (Flexible Printed Circuit) and a hard substrate) on which the socket 1010 and the header 1030 are mounted (see, for instance, JP-A-2002-008753).

The socket 1010 includes: a socket body 1011 made from a molded resin article defining a flat rectangular parallelepiped shape; and a plurality of socket contacts 1020 which are inserted into the socket body 1011 during resin molding process and which are formed by bending a strip-shaped metal material.

The header 1030 includes: a header body 1031 made from a resin molded article; and a plurality of header contacts 1040 which are inserted into the header body 1031 during resin molding process and which are formed by bending a strip-shaped metal material.

In order to make a connection with the head body 1031, an insertion groove 1012 is formed in the socket body 1011 along its longitudinal direction. The head body 1031 is inserted into the insertion groove 1012, whereby the socket contacts and the header contacts are brought into electrical connection with each other.

The header 1030 is inserted into the insertion groove 1012 of the socket 1010, whereupon a projecting mount of the header 1030 fits into the insertion groove 1012 of the socket 1010. Further, a contact portion of the socket contact 1020 comes into an elastic contact with a contact portion of the header contact 1040. Accordingly, a printed wiring board on which the socket 1010 is mounted and a printed wiring board on which the header 1030 is mounted are electrically connected together.

A coupling member as well as a coupling-type connector in which a plurality of such connectors are coupled and arranged on a circuit board has been proposed. The coupling-type connector includes a plurality of connectors coupled together in a longitudinal direction (JP-A-2005-294036), and the coupling member includes a plurality of connectors arranged in parallel (JP-A-8-250836).

Another proposed connector includes a plurality of surface-mounting connectors that are arranged in parallel and coupled together by means of a metal absorbing plate (JP-A-11-003752). The surface-mounting connectors prevents occurrence of deformation caused by heat generated during a solder reflow process when connection terminals of the connector are mounted on a circuit board, such as a printed wiring board, or prevents the connector from receiving damage generated during removal process after the solder reflow process, thereby maintaining flatness of the contacts and making the absorbing plate recyclable.

In the surface-mounting connector, engagement portions of the absorbing plate and engagement portions of the connector supported by the absorbing plate each are provided with a backlash space (a margin space). When the connector is placed on a horizontal surface of a printed circuit board (a printed wiring board), the connector can slightly move in a three-dimensional direction. Occurrence of warpage and lifting generated during the solder reflow process is prevented by assuring the backlash space, to thus enhance the flatness of the connector achieved after mounting of the connector.

SUMMARY OF THE INVENTION

However, in relation to a device requiring an ultra-multi-conductor connector having 200 conductors or more, a pitch becomes finer, and a footprint for mounting a connector becomes smaller. In the meantime, a demand for enhancement of dimensional accuracy increases, and size reduction and sophistication are becoming a serious problem.

In such a circumstance, when an attempt is made to realize the ultra-multi-conductor connector having 200 conductors or more by means of a single connector, a molded article becomes susceptible to warpage attributable to elongation of the connector. For this reason, a connector set in which a plurality of connectors are mounted in parallel is required. The connector set described in connection with JP-A-11-003752 using a structure for mounting two or more connectors in parallel enables performance of mounting with a high degree of flatness. However, the ultra-multi-conductor connector is not sufficient in terms of a reduction in mounting precision and footprint and meets the following challenges in order to meet a demand for further miniaturization, such as that mentioned previously.

In the connector described in connection with JP-A-11-003752, the connector is held so as to be sandwiched between metal absorbing plates. In particular, the socket wholly becomes greater and requires a footprint. Therefore, other components or other sockets cannot be mounted at adjacent positions, and limitations are encountered in increasing packing density. Since the absorbing plates are made of metal, the absorbing plates are likely to transmit heat to the connector during a solder reflow process for mounting the connector to a mounting board, such as a printed wiring board, thereby raising a problem of the connector itself being vulnerable to warpage, or the like.

As mentioned above, JP-A-11-003752 describes that flatness is enhanced when the margin space called the backlash space is provided. However, a displacement commensurate with the backlash space eventually arises. For this reason, when the printed wiring board (the circuit board) with the socket mounted thereon and a wiring board (the substrate), such as a flexible wiring board, with a head mounted thereon are connected together by means of engagement of the socket with the head, a problem, such as an engagement failure, may arise for reasons of a positional displacement occurring between the circuit boards. Therefore, a positional displacement absorbing mechanism must be provided on the connector, which in turn poses a problem of a further increase in footprint.

JP-A-8-250836 describes a coupling member that has at both longitudinal ends thereof a plurality of engagement portions and that is made of a resin. The coupling member is used for coupling together a plurality of connectors. Therefore, the coupling member is described as being able to maintain flatness of a terminal without inducing warpage or torsions of the connectors. However, even in this case, when the connector is mounted on the circuit boards, a play (a backlash space) is provided between the engagement portions of the coupling member and the connectors, whereby the connectors can freely move to an extent corresponding to the play, as in JP-A-11-003752. It is impossible to effect miniaturization that enables a reduction in footprint of a connector associated with recently-required miniaturization of a printed wiring board.

In order to attach the coupling member, coupling members equipped with retaining portions appropriate for respective types, such as a socket portion and a head portion of the connector, must be prepared, and at least two types of coupling members for use with the socket portion and the head portion are required. Moreover, in the case of use of two types of coupling members, a nominal dimensional error between the coupling members may pose difficulty in insertion and removal of a connector having a narrow pitch, which in turn result in deterioration of connection reliability.

Moreover, a coupling element for a socket portion is attached to one circuit board, and a coupling element for a head portion is attached to another circuit board. The coupling elements are not identical with each other in terms of a shape and a size. Therefore, when the coupling element for the socket portion and the coupling element for the head portion are mounted on the respective circuit boards, deformation attributable to the heat of a solder reflow process is likely to arise. For this reason, when an attempt is made to connect the circuit boards, as completed products, together by engagement of the coupling element for the socket portion and the coupling element for the head portion, difficulty may be encountered in engagement because of warpage or distortion.

The present invention was made in view of the circumstance, and an object thereof is to provide a connector set that enables connection between circuit boards by means of one type of socket and that has a fine pitch.

The present invention also provides a connector set that enables a further reduction in footprint and that obviates a necessity to form a backlash space, a deformation absorbing portion, and the like, and that enables high precision ultra-fine connection between circuit boards, as well as providing a jointer (a coupling member) for use in the connector set.

The present invention also provides a compact, high-dimensional-precision connector set that exhibits high connection reliability even in the case of a fine-pitch connector, as well as providing a jointer for use in the connector set.

According to an aspect of the invention, there is provided a connector set comprising: at least one of a header and a socket; and a jointer, wherein the header comprises: an insulating header main body; and a plurality of pairs of header contacts which are provided on the header main body and which are arranged along a first arranging direction so as to be in parallel with one another, wherein the header main body comprises first connecting portions provided at both end portions of the header main body in the first arranging direction, wherein the socket comprises: an insulating socket main body having an insertion groove having a shape which allows the header to be removably inserted therein; and a plurality of pairs of socket contacts which are provided on the socket main body and are arranged along a second arranging direction so as to be in parallel with one another, wherein the socket main body comprises second connecting portions provided at both end portions of the socket main body in the second arranging direction, and wherein the plurality of pairs of socket contacts are arranged to contact the plurality of pairs of header contacts when the header is inserted in the insertion groove of the socket, wherein the jointer is configured to couple the header and the socket such that the first arranging direction of the header and the second arranging direction of the socket are in parallel with a first direction, and such that the header and the socket are oriented so as to be electrically connected to a circuit board when the header and the socket are coupled by the jointer, and wherein the jointer comprises: a jointer body extending in the first direction, first jointer connecting portions which are provided at both end portions of the jointer body in the first direction, which extend in a second direction perpendicular to the first direction, and which are configured to engage the first connecting portions, and second jointer connecting portions which are provided at both end portions of the jointer body in the first direction, which extend in a third direction opposite to the second direction, and which are configured to engage the second connecting portions.

According to another aspect of the invention, there is provided a jointer for use in the connector set.

According to yet another aspect of the invention, there is provided a connector set comprising: a header which comprises an insulating header main body comprising first connecting portions provided at both end portions of the header main body, and a plurality of pairs of header contacts which are to contact a first circuit board and which are provided on the header main body along a first direction; a socket which comprises an insulating socket main body having an insertion groove having a shape which allows the header to be removably inserted therein, and comprising second connecting portions provided at both end portions of the socket main body, and a plurality of pairs of socket contacts which are to contact the first circuit board and which are provided on the socket main body along the first direction, such that contacts being arranged to contact the plurality of pairs of header contacts when the header is inserted in the insertion groove of the socket; and a jointer configured to couple the header and the socket such that the header and the socket are in parallel, the jointer comprising a jointer body extending in the first direction, first jointer connecting portions which are provided at both end portions of the jointer body, which extend in a second direction perpendicular to the first direction, and which are configured to engage the first connecting portions, and second jointer connecting portions which are provided at both end portions of the jointer body, which extend in a third direction opposite to the second direction that is perpendicular to the first direction, and which are configured to engage the second connecting portions.

BRIEF DESCRIPTION OF THE DRAWINGS

FIG. 3 is an oblique perspective view of the jointer making up the connector set of the embodiment of the present invention when viewed from a front surface of the jointer;

FIG. 4A is an oblique perspective view of the jointer making up the connector set of the embodiment of the present invention when viewed from a rear surface of the jointer, and FIG. 4B is a cross-sectional view cut along a line IVB-IVB shown in FIG. 4A;

FIGS. 7A to 7C are views showing the connector set of the embodiment of the present invention, in which FIG. 7A is a top view of the connector set, FIG. 7B is a front view of the connector set, and FIG. 7C is a side view of the connector set;

FIGS. 8A to 8C are views showing that the connector set of the embodiment of the present invention is mounted on a circuit board i.e., that the jointer is removed from the connector set, in which FIG. 8A is a top view of the connector set, FIG. 8B is a front view of the connector set, and FIG. 8C is a side view of the connector set;

DETAILED DESCRIPTION OF THE EXEMPLARY EMBODIMENT

An embodiment of the present invention is now described in detail by reference to the drawings. FIGS. 1 to 8 are views showing a connector set of the embodiment of the present invention. The connector set of the embodiment is used for a portable terminal, such as a portable phone, and implements a connection of ultra-fine pitch between terminals having a pitch of 0.35 mm.

Figure 1:
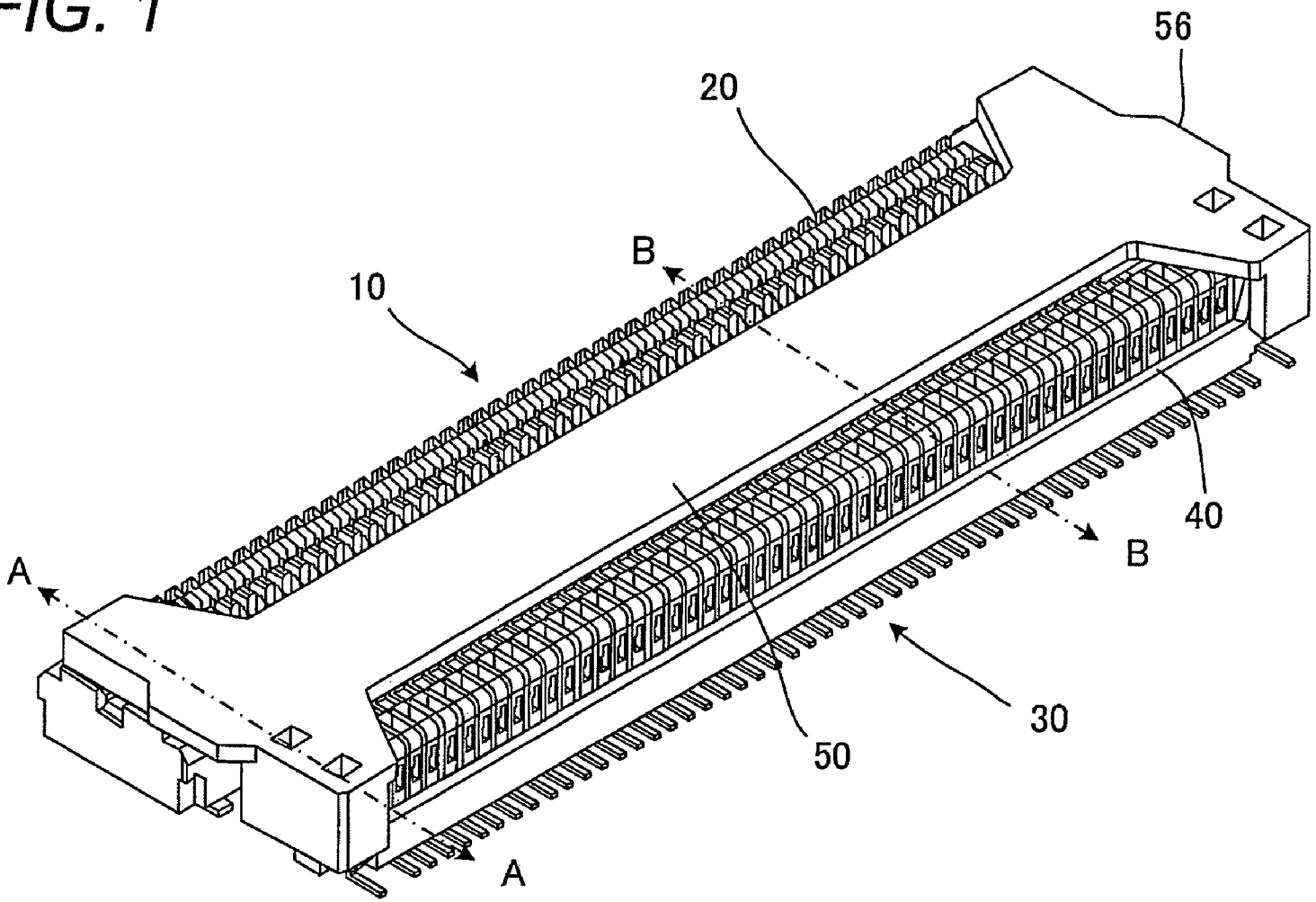
FIG. 1 is an oblique perspective view showing a connector set of an embodiment of the present invention.
Figure 2:
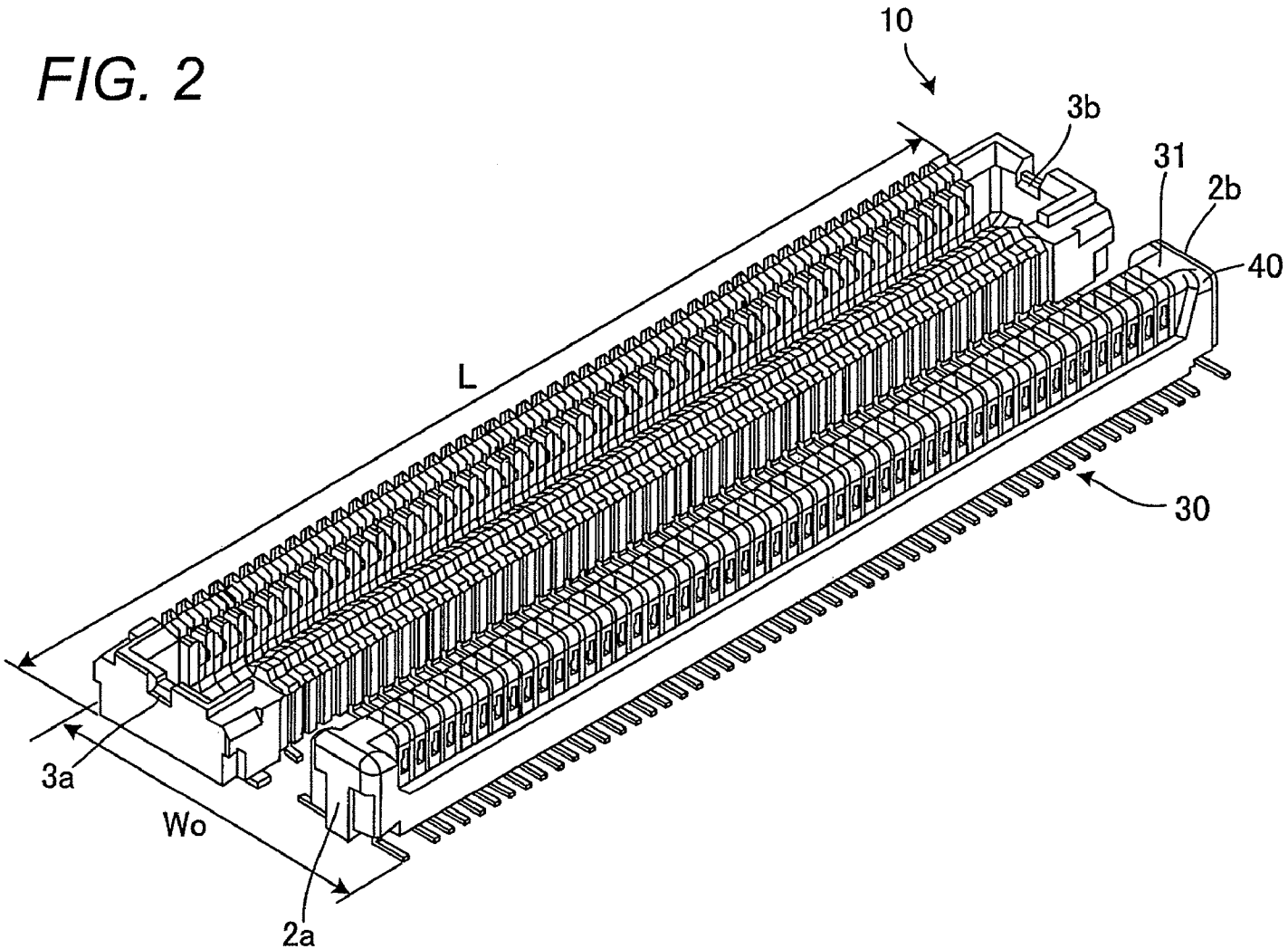
FIG. 2 is an oblique perspective view showing the connector set of the embodiment of the present invention (when a jointer is removed from the connector set)

A basic configuration of the embodiment is first described. As shown in oblique perspective views of FIGS. 1 and 2, the connector set of the embodiment is a connector set that connects one circuit board to another circuit board, for example, a flexible printed wiring board to a printed wiring board that is a hard substrate. FIG. 1 shows the connector set to which a jointer is attached, and FIG. 2 shows the connector set from which the jointer is removed. As shown in FIG. 1, the connector set is formed by fixedly connecting a socket 10 to a header 30 by means of a jointer 50 made of a resin molded article. The socket 10 includes a socket body 11 and a plurality of socket contacts 20 arranged in parallel on the socket body 11. The header 30 includes a header body 31 and a plurality of header contacts 40 arranged in parallel on the header body 31. The header contacts 40 contact and are electrically connected to respective socket contacts 20 of another connector set. The jointer 50 includes claws 56 used for removing the jointer 50. The length of the connector set is designated by reference symbol L, and the width of the connector set is designated by reference symbol W0. The connector set has no bulge formed by the jointer 50 in the lengthwise and widthwise directions. That is, the jointer 50 is arranged so as not to protrude out of outer edges of the socket and the header. When the connector set is formed by use of the jointer 50, an upper surface (an absorbing surface) of the jointer 50 is made substantially horizontal, so that the connector set can easily be mounted on a printed wiring board during mounting operation. Consequently, even when a height of the header is adjusted or a recess of the jointer is extended, since the upper surface of the jointer is made substantially horizontal, the connector set can easily be mounted.

In other words, the jointer 50 is configured to couple the socket 10 and the header 30 such that the direction in which the socket contacts 20 are arranged and the direction in which the header contacts 40 are arranged are in parallel with the longitudinal direction of the jointer 50 (i.e., the first direction A), and such that the socket 10 and the header 30 (more specifically, the socket contacts 20 and the header contacts 50) are oriented so as to be electrically connected to a circuit board when the socket 10 and the header 30 are coupled by the jointer 50.

Figure 5:
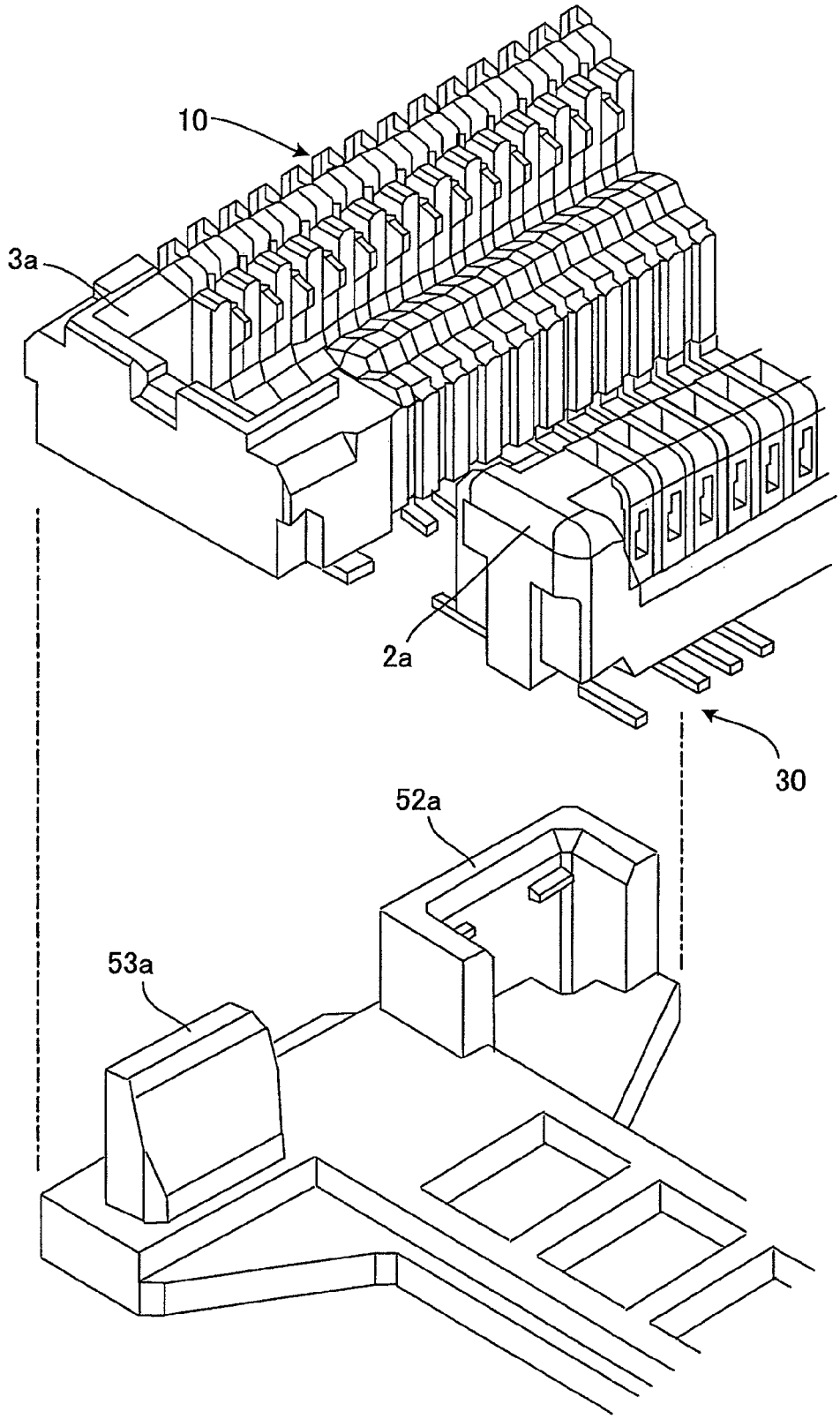
FIG. 5 is a diagram showing engagement of a socket and a header which form the connector set of the embodiment with the jointer.
Figure 6:
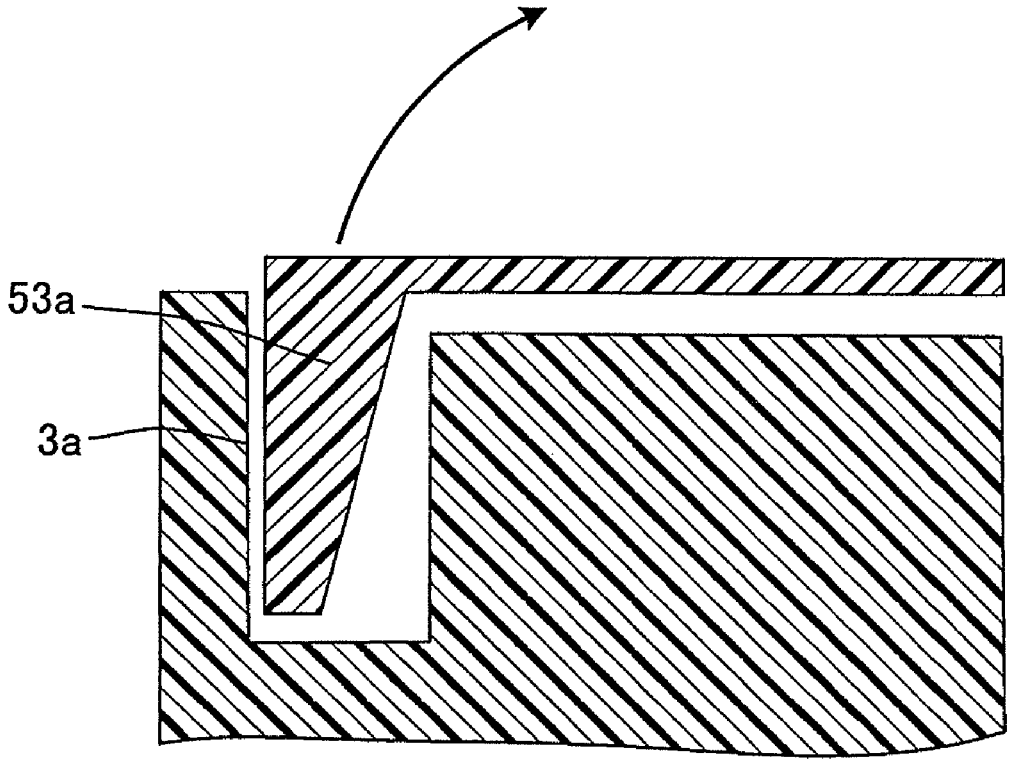
FIG. 6 is an enlarged descriptive view of a principal portion showing the engagement of the socket and the header, which make up the connector set of the embodiment of the present invention, with the jointer.
Figure 7C:
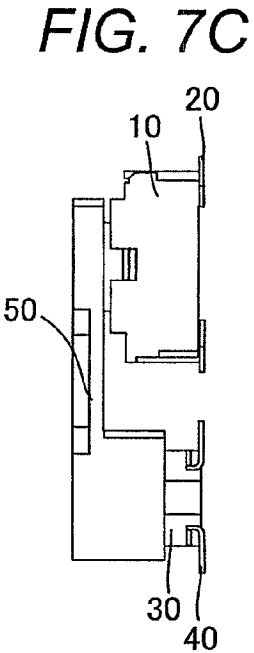
Figure 7A:
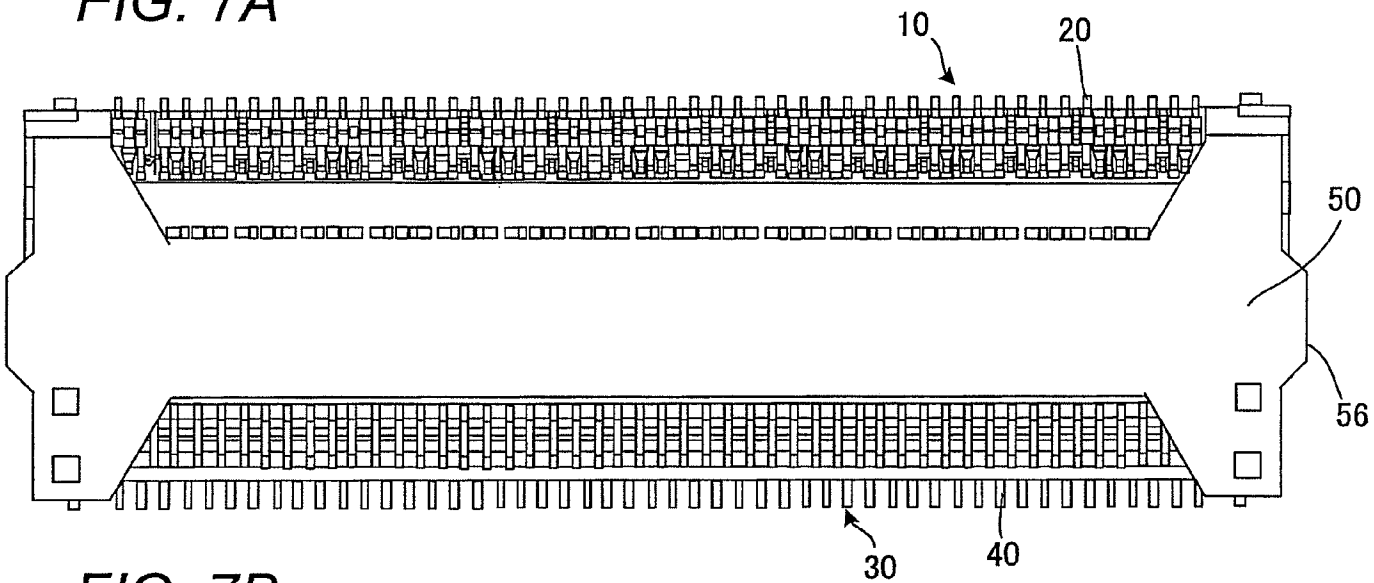
Figure 7B:
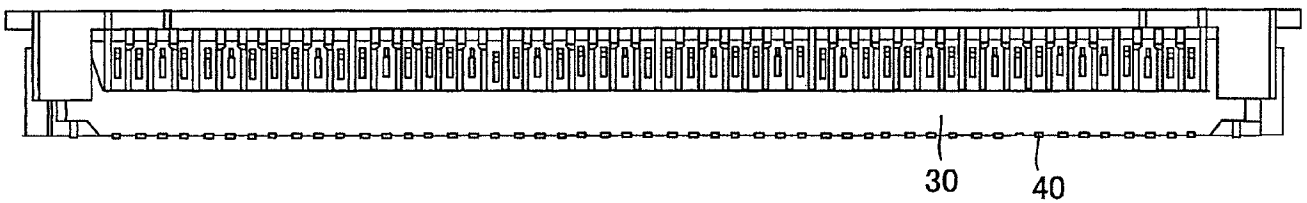
Figure 8C:
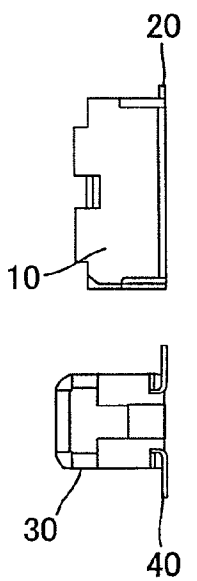
Figure 8A:
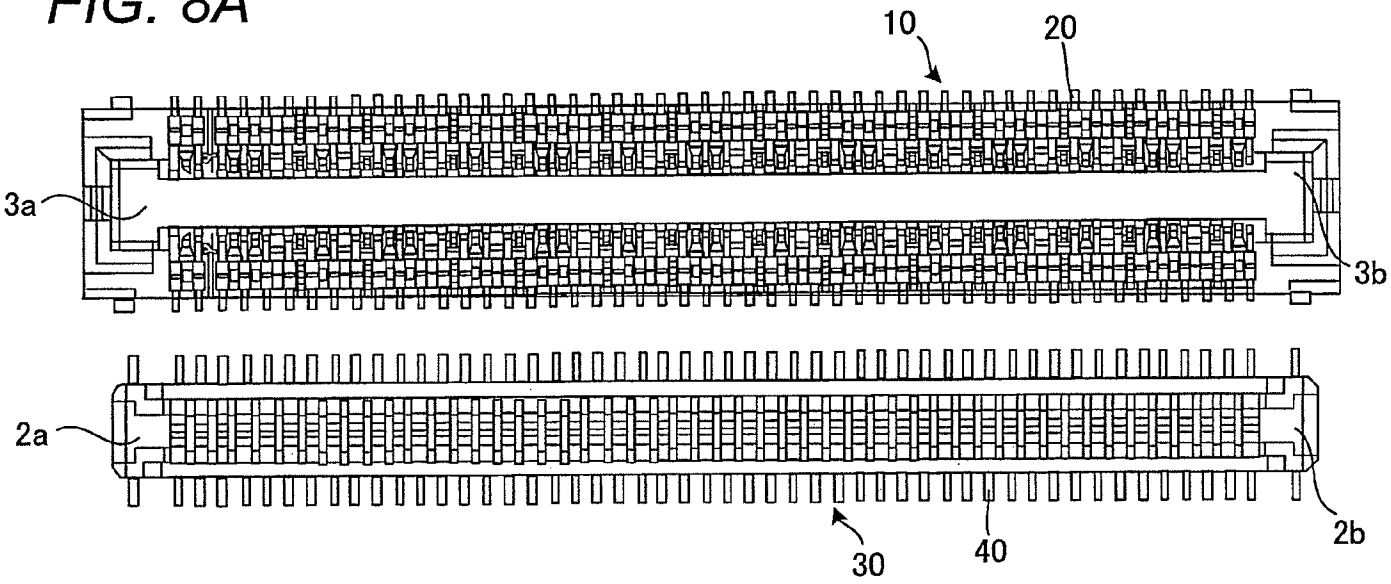
Figure 8B:
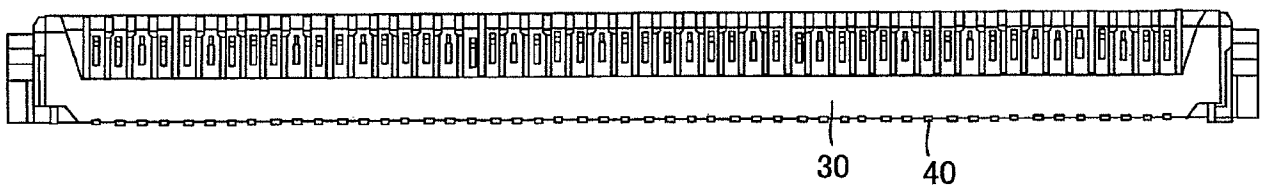

Specifically, as shown in FIGS. 3 to 8, the jointer 50 of the connector set of the embodiment includes first jointer connecting portions 52 (52*a*, 52*b*) and second jointer connecting portions 53 (53*a*, 53*b*). The first jointer connecting portions 52 (52*a*, 52*b*) engage first connecting portions 2 (2*a*, 2*b*) serving as engagement portions of the header 30, respectively. The second jointer connecting portions 53 (53*a*, 53*b*) engage second connecting portions 3 (3*a*, 3*b*) serving as engagement portions of the socket 10. Accordingly, the jointer 50 securely maintains positional accuracy of the socket 10 and the header 30 with high precision. FIG. 3 is an oblique perspective view of the jointer when viewed from its front side; FIG. 4A is an oblique perspective view of the jointer when viewed from its rear side and FIG. 4B is a cross-sectional view cut along a line IVB-IVB shown in FIG. 4A; and FIG. 5 is a descriptive view showing engagement of a socket and a header which form the connector set of the embodiment with the jointer. FIG. 6 is an enlarged diagram of a principal portion showing engagement between the second connecting portions 3 (3*a*, 3*b*) and the second jointer connecting portions 53 (53*a*, 53*b*) engaging the respective second connecting portions 3 (3*a*, 3*b*); FIGS. 7A to 7C are a top view, a front view, and a side view of the connector set; and FIGS. 8A to 8C are a top view, a front view, and a side view showing that the connector set is mounted on a circuit board, i.e., that the jointer is removed from the connector set.

As shown in FIG. 3 and FIGS. 4A and 4B, the jointer 50 includes a jointer body 51, the first jointer connecting portions 52 (52*a*, 52*b*), and the second jointer connecting portions 53 (53*a*, 53*b*). The jointer body extends in a first direction A. The first jointer connecting portions 52 (52*a*, 52*b*) are formed at both ends of the jointer body 51 so as to extend in a second direction L1 perpendicular to the first direction A in the top view, and configured to engage the first connecting portions 2*a*, 2*b* formed on the header 30. The second jointer connecting portions 53 (53*a*, 53*b*) are formed at both ends of the jointer body 51 so as to extend in a third direction L2 perpendicular to the first direction A and opposite to the second direction L1 in the top view, and configured to engage the second connecting portions 3*a* and 3*b* formed on the socket 10.

The jointer 50 is formed of a resin molded article formed from the same insulating resin as that of the socket body 11 and the header body 31, e.g., an epoxy resin. As shown in FIG. 3 and FIGS. 4A and 4B, the jointer body 51 has a flat surface having a width of 2.0 mm, and recess portions are formed on a side opposite to the flat surface. The jointer body 51 includes a thick frame portion 54 having a width D1 of about 0.3 mm and thin recess portions 55 having a thickness D2 of about 0.3 mm, as shown in FIG. 4B. According to the structure, the weight of the jointer 50 can be reduced while desired strength is maintained, without warpage or torsion. The jointer 50 also includes claws portions 56. When the jointer 50 is removed after the solder reflow process for fixing the connector set, the claw portions 56 allows the removal of the jointer 50 with small force.

As mentioned above, the jointer body 51 has the flat surface having the predetermined width. Consequently, even when the connector set is treated by automatic mounting operation, the jointer 50 can be held and conveyed without fail by use of a vacuum suction nozzle having a diameter smaller than the width of the flat surface of the jointer body 51. Therefore, the jointer 50 can reliably be inserted into and removed from the socket 10 and the header 30, so that automatic attachment of the jointer 50 becomes easily possible.

FIG. 6 is an enlarged cross-sectional view of the principal portion showing a connection with the jointer connecting portions 53 of the connector set. FIG. 6 is a view showing a connection between the second connecting portion 3*a* with the second jointer connecting portion 53*a*. The second jointer connecting portion 53*a* defines a protruding portion, and an inner side surface of the second jointer connecting portion 53 is tapered such that the thickness of the second jointer connecting portion 53*a* is reduced towards its distal end. Thus, the jointer 50 is easily inserted during insertion of the jointer 50, and the jointer 50 does not interfere with the inside of the connector set, such as contacts during removal of the jointer 50, thereby being easily removed.

As shown in FIGS. 7 and 8, the header 30 includes the plurality of pairs of header contacts 40 and the insulating header body 31. The header contacts 40 are provided so as to allow an electrical connection with a first circuit board 100 (see FIG. 12) and include a copper alloy plated with nickel and gold layers. On the insulating header body 31, the plurality of pairs of header contact 40 are arranged in parallel, and along the first direction A. The insulating header body 31 includes protruding first connecting portions 2*a* and 2*b* provided at both ends of the header body 31.

As shown in FIGS. 7 and 8, the socket 10 includes the plurality of pairs of socket contacts 20 and the insulating socket body 11. The socket contacts 20 are provided so as to allow an electrical connection with the first circuit board 100 (see FIG. 12) and include a copper alloy plated with nickel and gold layers. The second connecting portions 3*a* and 3*b* define recessed grooves formed at both ends of the socket body 11. The first connecting portions 2*a* and 2*b* of the header 30 are removably inserted into the recessed grooves. The plurality of pairs of socket contacts 20 are arranged in parallel, and along the first direction A so as to contact and to be electrically connected to the plurality of pairs of header contacts 40 of the header 30 of another connector set which is mounted on a second circuit board 200 (see FIG. 12), when the protruding first connecting portions 2*a* and 2*b* formed on the header 30 of another connector set are inserted into the second connecting portions 3*a* and 3*b*.

The first connecting portions 2*a* and 2*b* have shapes that is the inverse of those of the second connecting portions 3*a* and 3*b* regarding concave-convex relationship, such that they match each other.

A method for assembling the connector set is now described with reference to FIGS. 9A to 9D. FIGS. 9A to 9D are cross-sectional views (drawings equivalent to a cross-section A-A shown in FIG. 1) showing a process of mounting the connector set.

Figure 9A:
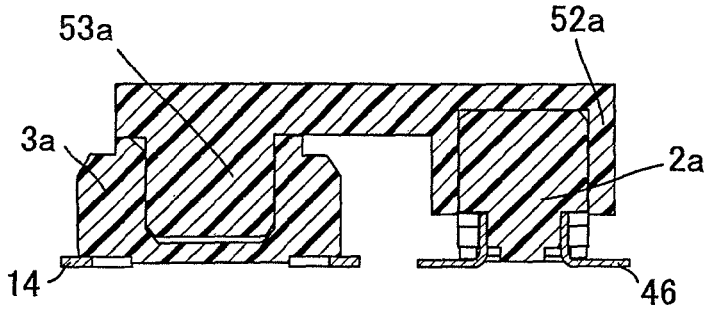
FIGS. 9A to 9D are cross-sectional views showing a process of mounting the connector set of the embodiment to the circuit board and a process of connecting circuit boards of the connector set.

First, as shown in FIG. 9A, the jointer 50 is placed on the socket 10 and the header 30, which are arranged in parallel and housed within a tray (not shown), from above by use of a vacuum suction nozzle (not shown). Accordingly, the first jointer connecting portions 52 (52*a*, 52*b*) of the jointer 50 engage the second connecting portions 2*a*, 2*b* of the socket 10. Also, the second jointer connecting portions 53 (53*a*, 53*b*) engage the first connecting portions 3*a*, 3*b* of the header 30.

Figure 9B:
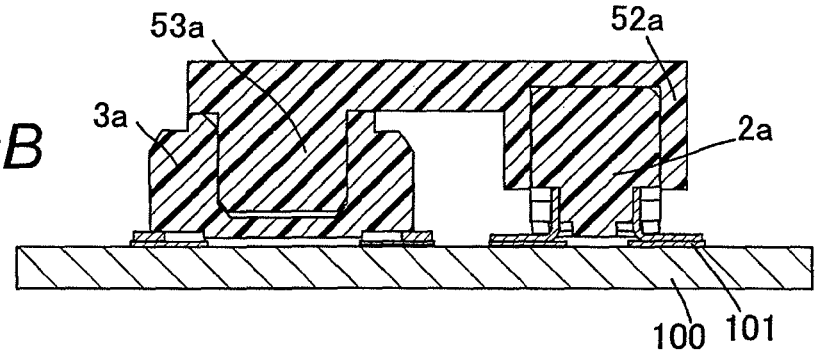
Figure 10:
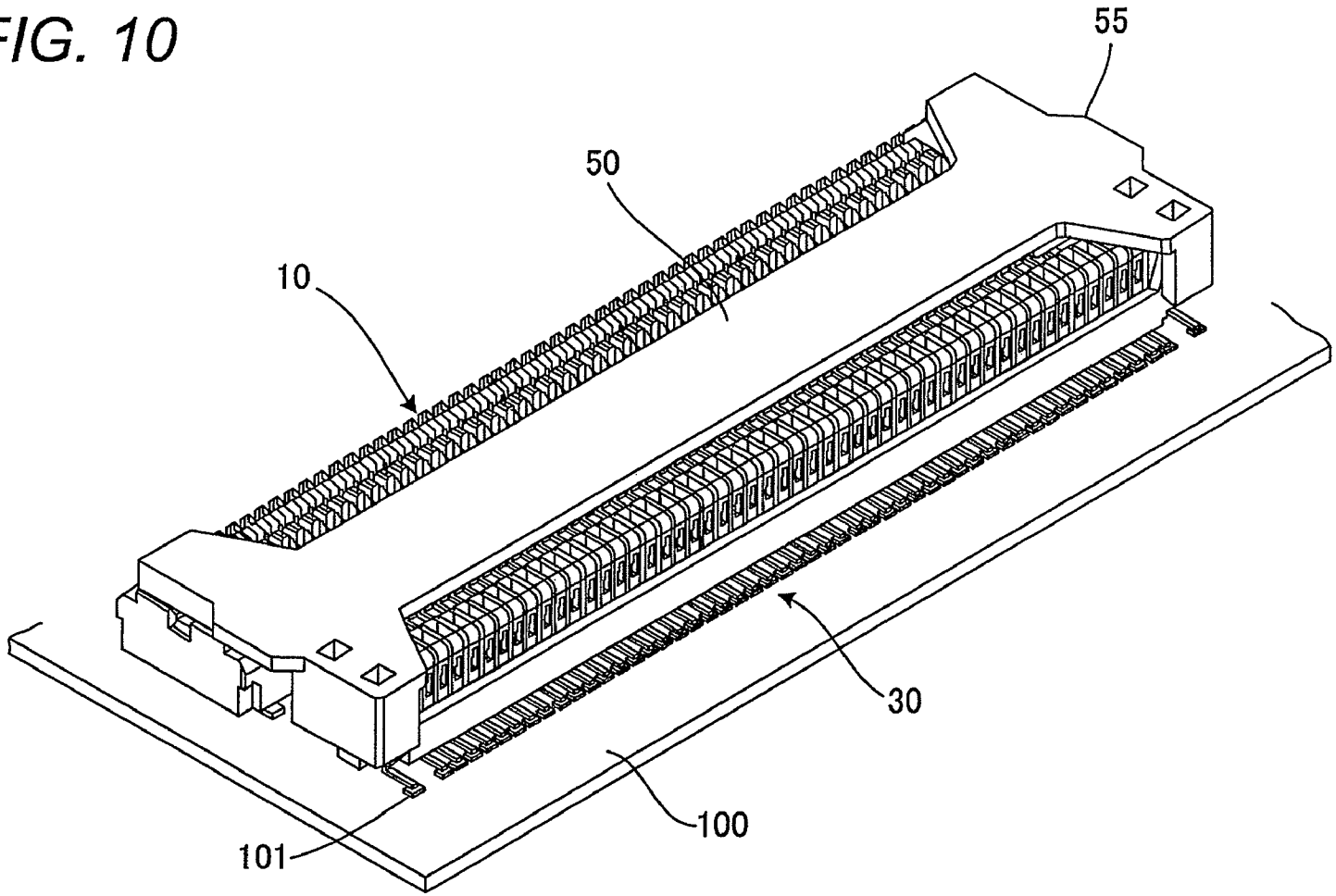
FIG. 10 is an oblique perspective view showing the process of mounting the connector set of the embodiment of the present invention to the circuit board and connecting circuit boards of the connector set.

As shown in FIG. 9B, terminals of the connector set are positioned to lands 101 of the first circuit board 100, and the connector set is subjected to a solder reflow process, whereby the connector set is mounted on the lands 101 of the first circuit board 100. FIG. 10 is an oblique perspective view showing the state. Since the first and second connecting portions 2 and 3 of the connector set are fixed by the first and second jointer connecting portions 52 and 53 at this time in the same manner as in the case of connection with the connectors of another connector set, deformation can be prevented to a minimum so as to facilitate, at least, the connection with the connectors.

Figure 9C:
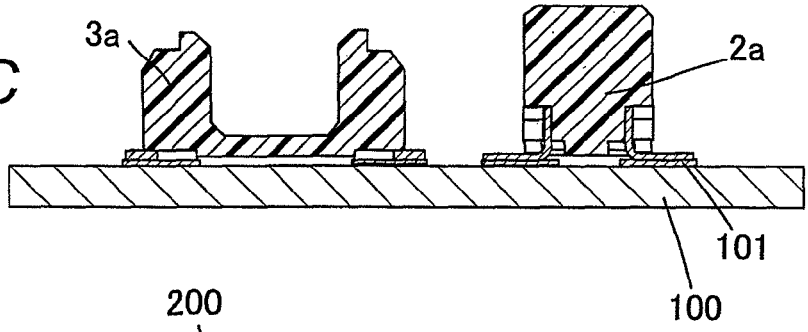
Figure 11:
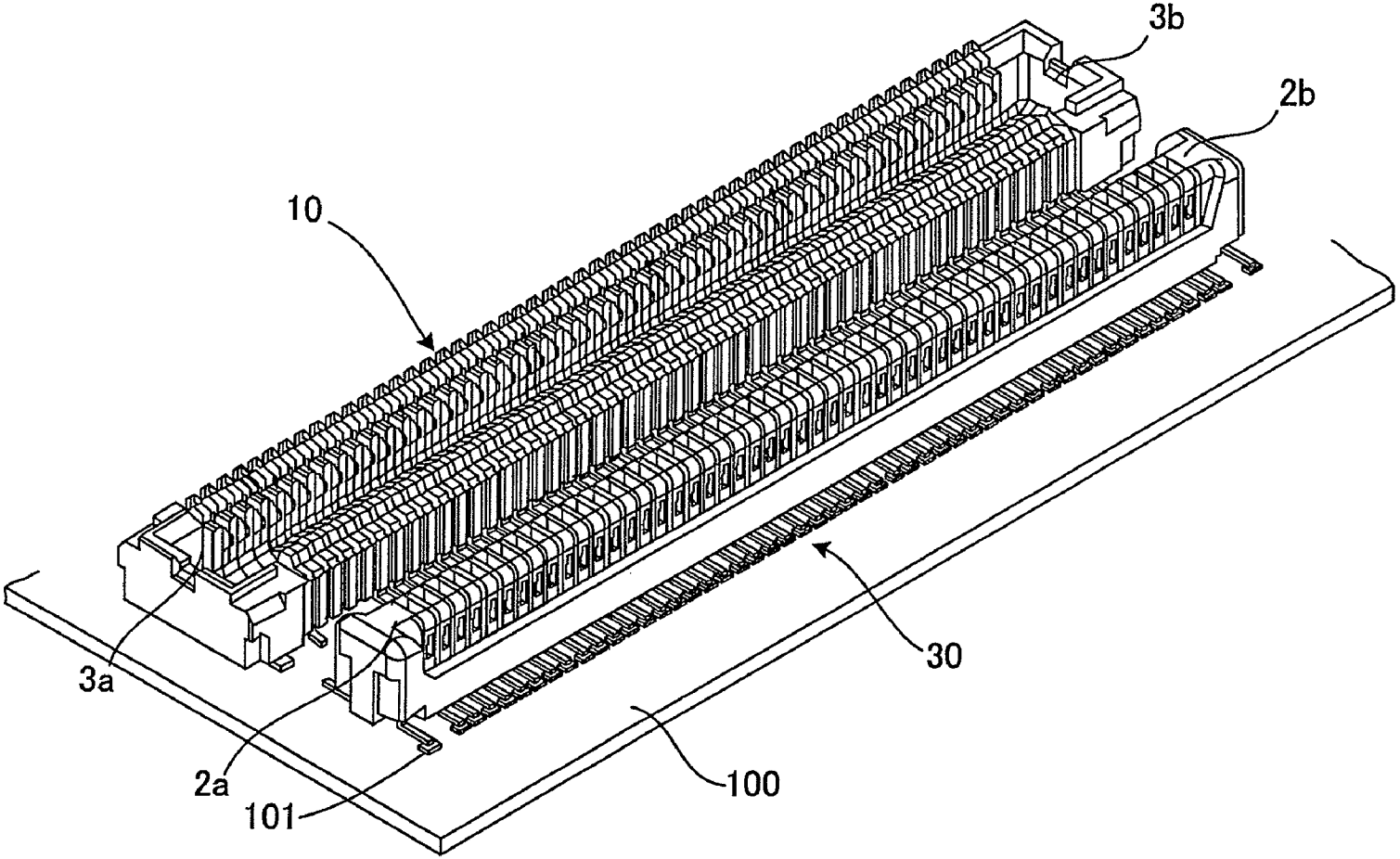
FIG. 11 is an oblique perspective view showing the process of mounting the connector set of the embodiment of the present invention to the circuit board and connecting circuit boards of the connector set.

As shown in FIG. 9C, after the lands of the first circuit board 100 and the terminals of the connector set are fixedly connected, the jointer is removed. FIG. 11 is an oblique perspective view of the connector set fixed to the lands of the circuit board after the removal of the jointer 50.

Meanwhile, another connector set is likewise mounted on lands of the second circuit board 200.

Further, after the lands of the second circuit board 200 and terminals of the connector set are fixedly connected, a jointer is removed.

Figure 9D:
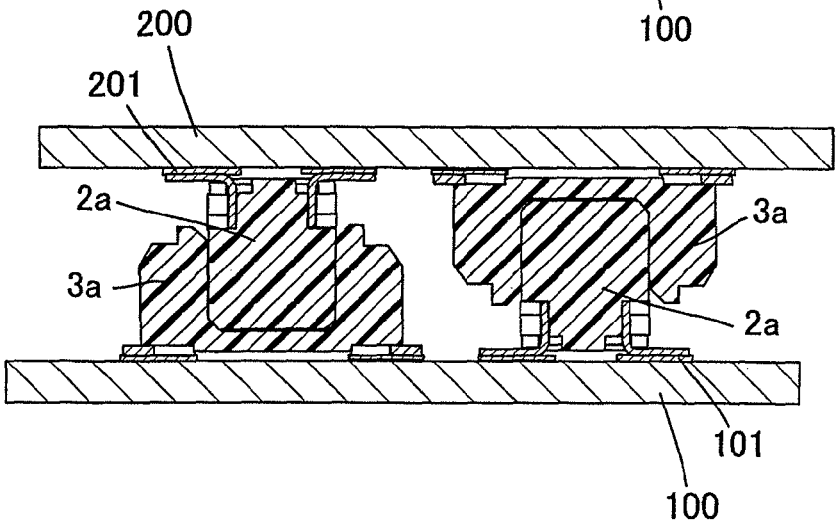

Thereafter, the first circuit board 100 and the second circuit board 200, to which connecter sets are attached, respectively, can be connected together so as to oppose each other via the connector sets interposed therebetween (FIG. 9D). When the first circuit board 100 and the second circuit board 200 are connected, the first connecting portion 2*a* of the header 30 of the connector set attached to the second circuit board 200 is inserted into the second connecting portion 3*a* of the socket 10 of the connector set attached to the first circuit board 100, and the second connecting portion 3*a* of the socket 10 of the connector set attached to the second circuit board 200 is inserted into the first connecting portion 2*a* of the header 30 of the connector set attached to the first circuit board 100.

In the example shown in FIGS. 9A to 9D, the second jointer connecting portion 53*a* is not provided with a tapered surface, which is different from that shown in FIG. 6, and a portion of the second jointer connecting portion 53*a* which contacts the second connecting portion 3*a* as a whole has the shape matching a portion of the second connecting portion 3*a*. In this case, preferably, at least the second jointer connecting portions 53*a* and 53*b* contain a more elastic material or a softer material. Accordingly, damage inflicted on a contact, which is caused by oblique removal of the jointer, can be prevented more reliably.

Figure 12:
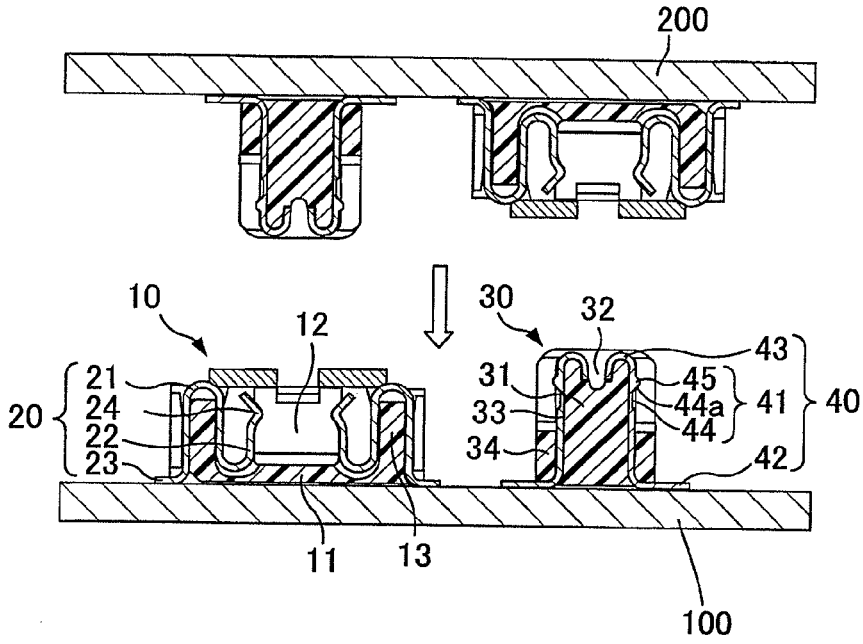
FIG. 12 is a cross-sectional descriptive view showing the process of mounting the connector set of the embodiment of the present invention to the circuit board and connecting circuit boards of the connector set.
Figure 13:
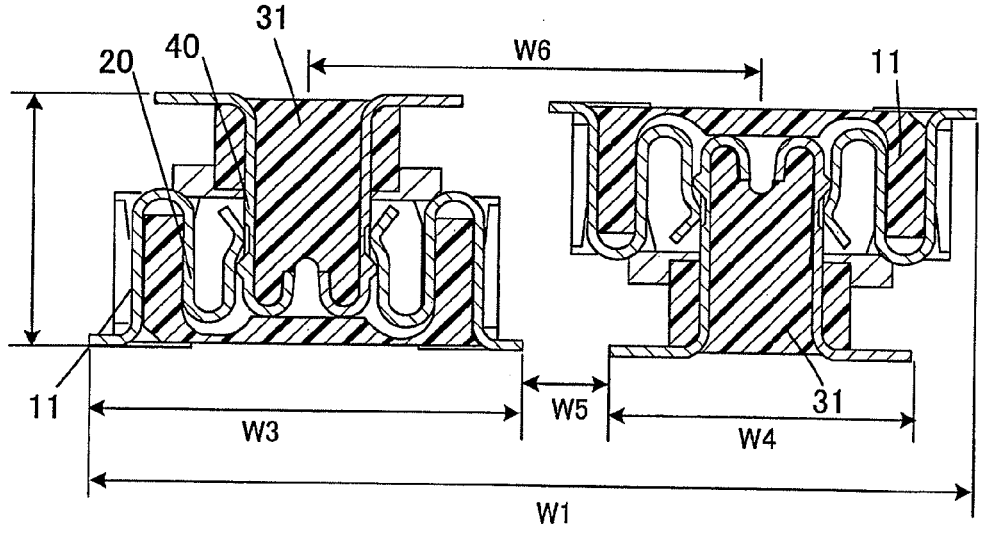
FIG. 13 is a descriptive view showing dimensions of the connector set of the embodiment of the present invention on the circuit board.

As shown in FIGS. 12 and 13, the socket contact 20 and the header contact 40 elastically contact each other in an intermediate area of the connector set, whereby reliable connection is realized. FIGS. 12 and 13 are drawings equivalent to a cross section B-B shown in FIG. 1.

Figure 15:
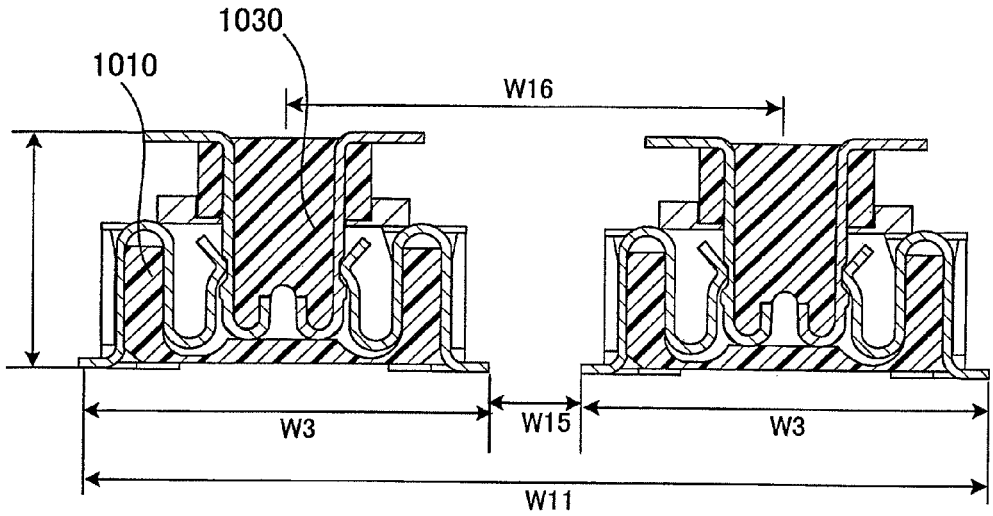
FIG. 15 is a descriptive view showing dimensions of a related-art example connector set on a circuit board.
Figure 16:
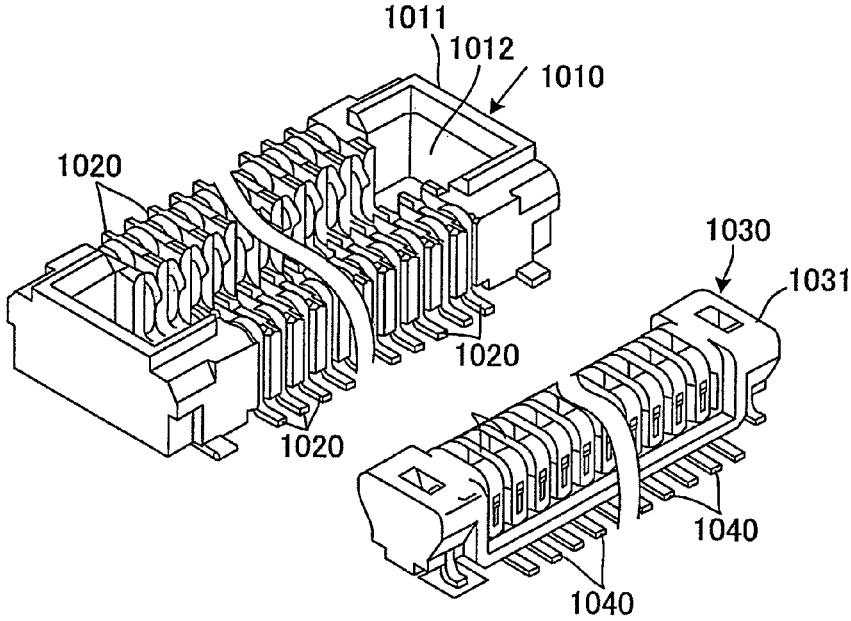
FIG. 16 is a descriptive view showing the related-art example connector set.

As shown in FIG. 13, in relation to a width W1 on the circuit board occupied by the mounted 200-conductor connector set, a space W5 between the socket 10 and the header 30 can be reduced to a minimum space required to solder the terminals to the lands. Further, since the connector set corresponds to a combination of the socket 10 with the header 30, the width of the connector set becomes a total sum of a socket width W3, a header width W4, and the space W5 between the socket 10 and the header 30. Reference symbol W6 designates a distance between the centers of the socket 10 and the header 30. On the contrary, as shown in FIG. 15, when related-art sockets or headers are combined together, widths of two wide sockets, i.e., 2×W3, are required. Therefore, as shown in FIG. 15, a width W11 on the circuit board occupied by the connector set comes to 7.5 mm. Since a space commensurate with an interval between the two sockets 1010 arranged in parallel is required, the distance W16 between the centers of the headers 1030 must also be increased, and the space becomes equal to a sum of the width W3 of the two sockets 1010 and the space W15 between the two sockets 1010. Therefore, the width W1 on the circuit board occupied by the connector set of the embodiment comes to 7.0 mm. When compared with the width W11 on the circuit board occupied by the related-art connector set is 7.5 mm, the width can be reduced by as many as 0.5 mm.

As described above, according to the connector set of the embodiment, the socket 10 and the header 30 are arranged in parallel. The first and second connecting portions 2, 3 which are provided at both ends of the socket 10 and the header 30, respectively, and form engagement portions for connecting the circuit boards, engage the first and second jointer connecting portions 52, 53 formed at both ends of the jointer 50. As a result, the socket 10 and the header 30 are fixed by the jointer 50 at the portions of the socket 10 and the header 30 which are originally used for engagements when the circuit boards are connected by use of the connector set, so that the circuit board and the connector set can be connected together. Therefore, the socket 10 and the header 30 can be fixed with considerably superior positional accuracy, and formation of the backlash space and the deformation absorbing portion becomes obviated. Consequently, a higher degree of positional accuracy can be attained, and a finer pitch becomes possible. Further, the space between the socket 10 and the header 30 can be reduced. Since the essential requirement is to arrange the socket 10 and the header 30 so as to ensure a space required when circuit boards are connected, an increase in footprint can be prevented, and connectivity can further be enhanced. Since the connector set is connected onto the circuit board through a solder reflow process while connected and fixed by the jointer at the position where the connector set is originally engaged, a high degree of positional accuracy can be maintained.

In particular, the conveyance process and a mounting process such as a solder reflow process are performed while the first and second connecting portions 2 and 3, which engage the second and first connecting portions 3 and 2 of another connecter set when circuit boards are actually connected together, are fixed by the first jointer connecting portion 52 and the second jointer connecting portion 53 of the jointer 50. Therefore, it is possible to prevent difficulty in insertion and removal during the connection between the circuit boards, which is caused by positional displacement resultant from deformation, such as warpage.

In addition, since the connector set is a combination of the socket 10 and the header 30, an identical combination of a socket 10 with a header 30 is provided on a counterpart circuit board that is to be engaged by means of insertion and removal. Since the degree of deformation occurring in a mounting process, such as a solder reflow process, is also identical, displacement attributable to a difference in coefficient of thermal expansion is less likely to arise, and superior engagement operability is exhibited at the time of insertion and removal of the circuit boards.

In the connector set, one of the first jointer connecting portion 52 and the second jointer connecting portion 53, which defines a protruding portion, have a tapered surface such that the thickness thereof is reduced toward their distal end. Hence, the jointer 50 can be prevented from interfering with and breaking the protruding portions of the header contact 40, which is caused by oblique removal of the jointer 50 when the jointer 50 is removed after the connector set has been soldered onto the circuit board.

According to the configuration, it is possible to prevent the contacts of the socket 10 or the header 30 from breaking caused by interfering with the protruding portions of the first or second jointer connecting portion 52, 53, which is caused when the jointer 50 is obliquely removed after the connector set has been soldered onto the circuit board.

The protruding portions may have side surfaces perpendicular to a top surface of the protruding portions, rather than the tapered surface.

In the embodiment, the jointer 50 is formed through integral molding by use of a metal mold. However, the jointer 50 is not necessarily made by monolithic molding. In some area of the jointer 50, the jointer body 51 and the first and second jointer connecting portions 52, 53 may also be made of different resins. For example, the jointer body 51 may be made of an epoxy resin, and the first and second jointer connecting portions 52, 53 may be made of a slightly-soft resin, for example, a polyimide resin. Moreover, the jointer body 51 may be made of a metal plate, and the first and second jointer connecting portions may be made of a resin.

In the embodiment, the second connecting portions 3 defining recess portions are formed at both ends of the socket 10, and the first connecting portions 2 defining protruding portions are formed at both ends of the header 30. However, the recess portion and the protruding portion may be formed at respective ends of each of the socket 10 and the header 30. In this case, jointer 50 thereby has a symmetrical geometry, so that occurrence of torsion in the jointer 50 can be prevented, and deformation, which is generated during the solder reflow process, can well be prohibited.

The socket 10 and the header 30 forming the connector set are finally described in detail.

Figure 14:
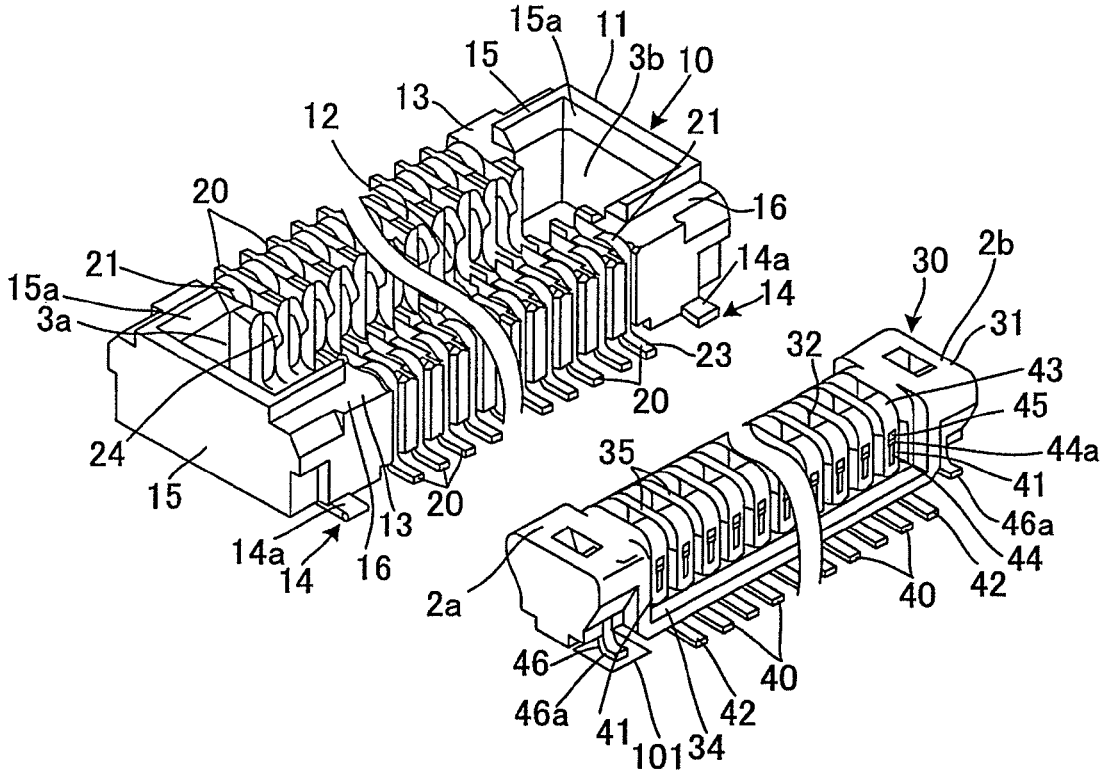
FIG. 14 is an oblique perspective view showing the socket and a connector of the connector set of the embodiment of the present invention.

As shown in FIG. 14, the socket body 11 of the socket 10 is of a resin molded article formed so as to have a substantially rectangular parallelepiped flat shape. The socket body 11 defines a rectangular recessed insertion groove 12 along its longitudinal direction. The plurality of socket contacts 20 are inserted when the socket body 11 is formed by the resin molding, and the plurality of socket contacts 20 are arranged in two rows on side walls 13, 13 provided on both sides of in the width direction of the insertion groove 12 of the socket body 11 extending along its longitudinal direction. A C-shaped guide wall 15 is formed on the surface of the socket body 11 which opposes the header 30 of another connector set, so as to protrude toward the header 30 of another connector set from edges of both longitudinal end portions of the second connecting portions 3 (3*a*, 3*b*). The guide wall 15 has an inclined surface 15*a* such that an amount of protrusion increases from the second connecting portion 3 (3*a*, 3*b*) toward the outside of the second connecting portion 3 (3*a*, 3*b*). According to such a configuration, when the first connecting portions 2 (2*a*, 2*b*) serving as protruding engagement portions of the header 30 of another connector set are inserted into the second connecting portions 3 (3*a*, 3*b*) of the socket body 11, the header 30 of another connector set is guided by the inclined surface 15*a* of the guide wall 15 provided along the circumferential edges of the second connecting portions 3 (3*a*, 3*b*), to thus be inserted into the insertion groove 12 of the socket 10. Therefore, even when a relative position between the socket body 11 and the header body 31 is slightly displaced, the header 30 can readily be inserted into the insertion groove 12 of the socket 10.

Each of the socket contacts 20 is made of a strip-shaped metal material. Each of the socket contacts 20 includes continually, integrally a holding portion 21, a resilient portion (a first contact portion) 22, and a strip-shaped terminal portion 23. The holding portion 21 is bent into a U-shaped form and is held on the socket body 11 so as to pinch an edge of the side wall 13 extending along the insertion groove 12 of the socket body 11 extending along its longitudinal direction. The resilient portion 22 extends from one end of the holding portion 21 at a position located inside of the insertion groove 12, so as to define an S-shaped form along with the holding portion 21. The resilient portion 22 is bendable in a direction in which the distance between the holding portion 21 and the resilient portion 22 changes (that is, in a direction crossing the direction of insertion and removal of the header 30 into and from the insertion groove 12). The terminal portion 23 is bent outwardly from one end of the holding portion 21 located outside of the insertion groove 12, to thus protrude in a direction substantially perpendicular to the side wall 13. The terminal portion 23 is soldered to the land 101 (see FIG. 9B) that is a conductor pattern of the circuit board 100, for example, a printed wiring board. In the resilient portion 22, a contact protrusion 24 protruding in a direction departing from the holding portion 21 is bent, and the contact protrusion 24 elastically protrudes in a direction crossing the direction of insertion and removal.

Socket reinforcing fittings 14 are simultaneously molded on longitudinal end portions 16 of the socket body 11 by means of insert molding. The socket reinforcing fitting 14 includes: a fixing piece 14*a* protruding sideways from a bottom of the end portion 16; a U-shaped connection piece (not shown) embedded in the end portion 16; and an L-shaped extension piece (not shown). The fixing piece 14*a* is connected to an exterior side of the extension piece, and the fixing piece 14*a* is arranged substantially flush with the terminal portion 23. When the terminal portions 23 of the socket contacts 20 are fixedly soldered to the lands 101 made of the conductor pattern of the circuit board 100, such as a printed wiring board, the fixing pieces 14*a* are fixedly soldered to the lands (not shown), whereby the socket reinforcing fittings 14 can reinforce the fixing force exerted on the circuit board of the socket body 11, and stress exerted on the socket contacts 20 during fitting of the connectors can be decreased. Further, since the socket reinforcing fitting 14 is embedded in the socket body 11, the mechanical strength of the socket body 11 can be enhanced. Moreover, the socket reinforcing fitting 14 is provided on the socket body 11 by insert molding, the socket body 11 does not need to ensure a thickness, such as that required in a case where socket reinforcing fitting 14 is held by means of press-fitting.

The header body 31 of the header 30 is made of a resin molded article having an elongated, substantially rectangular parallelepiped shape. A mount groove 32 is formed in a longitudinal direction in an area where the header contacts 40 are to be arranged, at a lateral center of the surface of the header body 31 opposing the socket body 11 of another connecter set. The header body 31 further includes flange portions 34 protruding from side walls 33 in a substantially perpendicular direction along edges on the back side of the side walls 33, 33 (i.e., a side of the side walls opposite to the socket 10 of another connector set) on both sides of the mount groove 32. The plurality of header contacts 40 are arranged in parallel in two rows on exterior surfaces of the respective side walls 33, 33 of the header body 31 along a longitudinal direction of the header body 31. Moreover, a plurality of partition walls 35 that connect the side walls 33, 33 opposing each other across the mount groove 32 are formed integrally with the header body 31 so as to extend from the bottom of the mount groove 32 to the opening of the mount groove 32. Each of the partition walls 35 is interposed between the adjacent header contacts 40 in the longitudinal direction of the header body 31.

Each of the header contacts 40 is formed by bending a strip metal material and simultaneously molded on the header body 31 by means of insert molding. The header contact 40 is formed to follow along outer wall of the side wall 33 of the header body 31, and includes a second contact portion 41 to be contacted with the contact protrusion 24 of the socket contact 20, a terminal portion 42 formed to protrude outward in a direction substantially perpendicular to the side wall 33 from the flange portion 34 and to be soldered on a conductive pattern of a circuit board, and a curved portion 43 formed in a substantially reverse U-shape striding across the side wall 33 from the vicinity of a peak of the side wall 33 and reaching the vicinity of a bottom of the concave portion 32. A curvature radius of outer surface side of the curved portion 43 is established to be the smallest curvature radius so that the resilient portion (first contact portion) 22 of the socket contact 20 is hardly buckled due to scratching with the curved portion 43.

Furthermore, a protrusion 44 and a concavity 45 are provided at positions of the second contact portion 41 of the header contact 40 where the contact protrusion 24 of the socket contact 20 slides. Specifically, the protrusion 44 is formed at a position a little upper (opposite side to the protrusion of the terminal portion 42) than the center of the header contact 40 in height direction. A slanted face 44*a* is formed on an outer face of the protrusion 44 so that a dimension of protrusion at a portion closer to the terminal portion 42 becomes larger. The concavity 45 has a channel shape extending along the height direction of the header contact 40, and has two slanted faces depth of which becomes deeper for approaching to the center in the width direction so that the section in the width direction of the header contact 40, that is, the direction crossing at right angle with the height direction becomes substantially V-shape.

A width dimension of the concavity 45 in the width direction of the header contact 40 is formed to be wider than a width dimension of the protrusion 44, and smaller than a width dimension of the contact protrusion 24. In addition, the dimensions and position of the concavity 45 in the height direction of the header contact 40 are established in a range that the contact protrusion 24 of the socket contact 20 slides on the second contact portion 41.

According to such configuration, under a state that the header 30 is fully inserted into the insertion groove 12 of the socket 10 as shown in FIG. 13, the contact protrusion 24 contacts both side portion of the concavity 45, and the protrusion 44 is positioned in the bottom face side of the insertion groove 12 from the contact protrusion 24. Furthermore, in a process for inserting the header 30 into the insertion groove 12 of the socket 10, the contact protrusion 24 elastically contacts both sides of the concavity 45 in the second contact portion 41 of the header contact 40. Still furthermore, an area of the contact protrusion 24 which contacts the protrusion 44 is not overlapped to an area contacting the both sides of the concavity 45. Thus, even though extraneous substance is adhered on the contact protrusion 24 of the socket contact 20 or the second contact portion 41 of the header contact 40 before the socket 10 and the header 30 are connected, the extraneous substance can be dropped into the concavity 45 in the process that the contact protrusion 24 slides on the surface of the second contact portion 41. Accordingly, in comparison with the case that no concavity 45 is provided on the second contact portion 41 of the header contact 40, the possibility that the extraneous substance is wedged between the contact protrusion 24 and the second contact portion 41 becomes lower. In other words, by providing the protrusion 44 and the concavity 45 on the second contact portion 41 of the header contact 40, poor contacting between the socket contact 20 and the header contact 40 due to extraneous substance can be prevented. Furthermore, the contact protrusion 24 contacts at two points on both sides of the concavity 45, so that contact reliability of the socket contact 20 and the header contact 40 can be increased. Still furthermore, the concavity 45 is provided on the second contact portion 41 of the header contact 40 in the range of sliding of the contact protrusion 24, so that the extraneous substance adhered on the contact protrusion 24 can be dropped in the concavity 45 surely, in comparison with the case that the concavity 45 is provided at a portion outside the range of sliding of the contact protrusion 24.

Furthermore, when force is applied to the header 30 in a direction pulled out from the insertion groove 12 of the socket 10, the contact protrusion 24 of the socket contact 20 contacts the protrusion 44 of the header contact 40, so that it receives resistance force from the protrusion 44. Therefore, there is an advantageous merit that the header 30 is hardly pulled out from the insertion groove 12 of the socket 10. By the way, when the header 30 is inserted into the insertion groove 12 of the socket 10, the contact protrusion 24 of the socket contact 20 contacts the protrusion 44 of the header contact 40. However, since the slanted face 44*a* is formed on the protrusion 44 such that the protruding dimension becomes larger at a position closer to the terminal portion 42, the resistance when the header 30 is inserted into the insertion groove 12 becomes smaller than the resistance when the header 30 is pulled out from the insertion groove 12. Furthermore, since the position and shape of the concavity 45 is established such that the range contacting the protrusion 44 is not overlapped with the range contacting both sides of the concavity 45 on the contact protrusion 24, the extraneous substance pushed by the contact protrusion 24 is dropped into the concavity 45 while the contact protrusion 24 slides on the surface of the protrusion 44 and rarely wedged between the contact protrusion 24 and the second contact portion 41.

In addition, header reinforcing metal fittings 46 are integrally embedded with the header body 31 by insert molding in both end portions of the header body 31 in the longitudinal direction. The header reinforcing metal fittings 46 are formed on the same base metal as the header contacts 40, and has substantially the same cross-sectional shape as shown in FIG. 14. In other words, the header reinforcing metal fittings 46 correspond to called loss pins which are not electrically connected among the header contacts 40. However, a portion of the header reinforcing metal fitting 46 corresponding to the second contact portion 41 is embedded in the both end portions of the header body 31 so that it is not exposed. As shown in FIG. 14, a fixing piece 46*a* of the header reinforcing metal fitting 46 corresponding to the terminal portion 42 may be cut off shorter than the terminal portion 42 of the header contact 40 so as to be substantially the same as the largest dimension of the header body 31 in the width direction. A protrusion 44 and a concavity 45 are provided on each header reinforcing metal fitting 46, similar to the header contact 40. With inserting such a header reinforcing metal fitting 46 into the header body 31, resin which forms the header body 31 tightly contacts on the surfaces of the protrusion 44 and the concavity 45, so that the fixing strength between the header reinforcing metal fitting 46 and the header body 31 is increased, and the mechanical strength of the header body 31 is increased. Furthermore, since the header reinforcing metal fittings 46 are inserted into the header body 31, both end portions of the header body 31 in the longitudinal direction can be made smaller in comparison with the case that the header reinforcing metal fittings are press-fitted into the header body.

The fixing piece 46*a* of the header reinforcing metal fittings 46 are soldered on lands 101 (see FIG. 9B) of a circuit board, when the terminal portions 42 of the header contacts 40 are soldered on a conductive pattern of the circuit board, simultaneously. Thereby, fixing strength of the header body 31 to the circuit board can be reinforced. Furthermore, the stress applied to the header contact 40 when the socket 10 and the header 30 are connected can be reduced by the fixing piece 46*a* of the header reinforcing metal fittings 46. In other words, the header reinforcing metal fittings 46 serve as the terminal reinforcing metal fittings of the header contacts 40.

In the above-described embodiment, the connector set includes a combination of the socket, the header and the jointer. However, even when the connector set includes the jointer and only one of the socket and the header but the jointer having the structure capable of coupling both the socket and the header as in the embodiment, such connector set can provide at least one of advantages of the embodiments, for example, the precise positional accuracy of one of the socket 10 and the header 30, e.g., at the mounting process, and the high connection reliability. In other words, the connector set may include the jointer and at least one of the socket and the header.

As described above, a connector set of the embodiment of the present invention includes at least one of a socket and a header, and a jointer configured to couple both end portions of the socket and both end portions of the header so as to arrange them in parallel. Regarding the socket and the header, first and second connecting portions, which form engagement portions during the connection between circuit boards, engage first and second jointer connecting portions formed at both ends of the jointer. As a result, portions of the socket and portions of the header, which originally engage the portions of the header and portions of the socket of another connector set when circuit boards are connected, are fixed together by means of the jointer, whereby the circuit board and the connector set are connected together.

Specifically, the connector set of the embodiment includes at least one of a header and a socket and a jointer. The header includes: an insulating header body; and a plurality of pairs of header contacts which are provided on the header body and which are arranged along a first arranging direction so as to be in parallel with one another. The header body comprises first connecting portions provided at both end portions of the header body in the first arranging direction. The socket includes: an insulating socket body defining an insertion groove having a shape which allows the header to be removably inserted therein; and a plurality of pairs of socket contacts which are provided on the socket body and are arranged along a second arranging direction so as to be in parallel with one another. The socket body includes second connecting portions provided at both end portions of the socket body in the second arranging direction. The plurality of pairs of socket contacts are arranged to contact the plurality of pairs of header contacts when the header is inserted in the insertion groove. The jointer is configured to couple the header and the socket such that the first arranging direction of the header and the second arranging direction of the socket are in parallel with a first direction, and such that the header and the socket are oriented so as to be electrically connected to a circuit board when the header and the socket are coupled by the jointer. The jointer includes: a jointer body extending in the first direction, first jointer connecting portions which are provided at both end portions of the jointer body in the first direction, which extend in a second direction perpendicular to the first direction, and which are configured to engage the first connecting portions, and second jointer connecting portions which are provided at both end portions of the jointer body in the first direction, which extend in a third direction opposite to the second direction, and which are configured to engage the second connecting portions.

According to the configuration, the jointer can couple the socket and the header so as to be arranged in parallel with each other. The first and second connecting portions are provided at both ends of the socket and both ends of the header, respectively, and also form engagement portions at the time of connection of circuit boards. Such the first and second connecting portions engage first and second jointer connecting portions formed at both ends of the jointer. As a result, the jointer can fix the socket and the header at portions of the socket ant the header which are originally used for engagements at the time of connection of circuit boards using the connector set, and the connector set can be connected to the circuit board. Accordingly, the socket and the header can be fixed with considerably superior positional accuracy, and formation of the backlash space and the deformation absorbing portion becomes obviated. Therefore, a higher degree of positional accuracy can be attained, and a finer pitch becomes possible. Further, the space between the socket and the header can be reduced. Since the essential requirement is to arrange the socket and the header so as to ensure a space required when circuit boards are connected together, an increase in footprint can be prevented, and connectivity can further be enhanced. Since the connector set is connected onto the circuit board through a solder reflow process while connected and fixed by the jointer at the position originally used for the engagement at the time of connecting the circuit boards, a high degree of positional accuracy can be maintained. In particular, the conveyance process and a mounting process such as a solder reflow process are performed while the first and second connecting portions, which engage the second and first connection portions of another connector set when the circuit boards are actually connected together, are fixed by the first jointer connecting portion and the second jointer connecting portion of the jointer. Therefore, it is possible to prevent difficulty in insertion and removal during the connection between the circuit boards, which is caused by positional displacement resultant from deformation, such as warpage.

In addition, when the connector set includes a combination of the socket and the header, an identical combination of a socket with a header is provided on a counterpart circuit board that is to be engaged by means of insertion and removal. Since the degree of deformation occurring in a mounting process, such as a solder reflow process, is also identical between one circuit board and another circuit board, displacement attributable to a difference in coefficient of thermal expansion is less likely to arise, and superior engagement operability is exhibited at the time of insertion and removal of the circuit boards.

In the connector set, the header connecting portions and the second jointer connecting portions may have a substantially same shape at least in a portion which contacts the first jointer connecting portions and at least in a portion which contacts the connecting portions, respectively, and the second connecting portions and the first jointer connecting portions may have a substantially same shape at least in a portion which contacts the second jointer connecting portions and at least in a portion which contacts the first connecting portions, respectively.

According to the configuration, portions of the socket and the header which contact the jointer when the connecting portions of the socket and the header of the connector set engage the connecting portions of the jointer have the same shapes as those of the jointer. Therefore, in a portion of the jointer fitted to the connector set, the jointer connecting portions assume the same shape as those of the connecting portions of the socket and the header of the connector set. Therefore, displacement caused by a difference in coefficient of thermal expansion is prevented more thoroughly, and the socket and the header are maintained in the same manner as in a case where connector connection is performed, whereby the position of the socket contact and the position of the header contact can be maintained with high accuracy.

The second connecting portions may be recess portions, and the first connecting portions may be protruding portions fitting to the recess portions.

According to the configuration, the socket having a larger width can be formed to have recess portions, and the header can be formed to have protruding portions. Therefore, the socket and the header can be fixed while remaining in tight contact without involvement of clearance, so that stable connection is realized.

The jointer may be a resin molded article.

According to the configuration, a plurality of jointers having the same shape can be formed by metal molding, which can realize low cost, few machining errors, and enhancement of high dimensional accuracy. Further, when compared with a metal jointer, a resin jointer is less prone to flaws during removal.

The jointer body may have a flat surface of a given width and an irregular surface opposing the flat surface.

According to the configuration, on the occasion of automatic mounting operation, a jointer can readily be automatically mounted by use of a vacuum suction nozzle having a nozzle whose width is smaller than the flat surface of the jointer body. Further, the jointer has the irregular surface on the back side thereof, and hence a lighter-weight jointer can be implemented while predetermined strength of the jointer is maintained so as to prevent occurrence of warpage and torsion.

The socket body and the header body may be made of the same insulating resin as that of the jointer.

According to the configuration, the coefficient of thermal expansion can be made constant. Hence, a higher degree of positional accuracy can be implemented. If the socket body and the header body are formed from different insulating resins, the jointer may be made from the same material as either of the insulating resins.

One of the first jointer connecting portion or the second jointer connecting portion, which defines the protruding portions, have a tapered surface which becomes thinner toward a distal end thereof.

According to the configuration, contacts of the socket or the header can be prevented from interfering with and breaking the protruding portions of the first or second jointer connecting portions, which is caused by oblique removal of the jointer when the jointer is removed after the connector set has been connected to the circuit board by soldering.

The embodiment of the invention also provides a jointer used in the above described connector set.

According to the embodiment of the present invention, the space between the socket and the header can be reduced, and further enhancement of positional accuracy and a reduction in the chance of occurrence of warpage and torsion can be accomplished. Hence, a deformation absorbing portion becomes also unnecessary, and a miniature connector involving a truly fine pitch can be produced.

This application is based on Japanese Patent Application No. 2009-126553 filed on May 26, the above application incorporated herein by reference in its entirety.

What is claimed is:

1. A connector set comprising;

a header; and a jointer, wherein the header comprises:

an insulating header main body; and a plurality of pairs of header contacts which are provided on the header main body and which are arranged along a first arranging direction so as to be in parallel with one another, wherein the header main body comprises first connecting portions provided at both end portions of the header main body in the first arranging direction and wherein the header is configured to engage a socket comprising second connecting portions and the first connecting portions have a shape to engage the second connecting portions when the header engages the socket, wherein the jointer is configured to couple the header such that the first arranging direction of the header is in parallel with a first direction, and such that the header is oriented so as to be electrically connected to a circuit board when the header is coupled by the jointer, and wherein the jointer comprises:

a jointer body, and first jointer connecting portions which are provided at both end portions of the jointer body, which extend in a second direction perpendicular to the first direction, and which are configured to engage the first connecting portions, wherein the first jointer connecting portions have a substantially same shape as the second connecting portions.

2. A connector set comprising:

a socket; and a jointer, wherein the socket comprises;

an insulating socket main body having an insertion groove; and a plurality of pairs of socket contacts which are provided on the socket main body and are arranged along a second arranging direction so as to be in parallel with one another, wherein the socket main body comprises second connecting portions provided at both end portions of the socket main body in the second arranging direction and wherein the socket is configured to engage a header comprising first connecting portions and the second connecting portions have a shape to engage the first connecting portions when the socket engages the header, and wherein the jointer is configured to couple the socket such that the second arranging direction of the socket is in parallel with a first direction, and such that the socket is oriented so as to be electrically connected to a circuit board when the socket is coupled by the jointer, and wherein the jointer comprises:

a jointer body, and second jointer connecting portions which are provided at both end portions of the jointer body, which extend in a third direction perpendicular to the first direction, and which are configured to engage the second connecting portions, wherein the second jointer connecting portions have a substantially same shape as the first connecting portions.

3. A connector set comprising:

at least one of a first connector member and a second connector member, the first connector member having a shape capable of engaging the second connector member; and a jointer, wherein the first connector member comprises a first main body comprising first connecting portions provided at both end portions of the first main body, wherein the second connector member comprises a second main body comprising second connecting portions provided at both end portions of the second main body, wherein the first connecting portions have a shape capable of engaging the second connecting portions if the first connector member were to engage the second connector member, wherein the jointer is configured to couple the first connector member and the second connector member such that the first connector member and the second connector member are in parallel with a first direction, and such that the first connector member and the second connector member are oriented so as to be electrically connected to a circuit board when the first connector member and the second connector member are coupled by the jointer, and wherein the jointer comprises:

a jointer body, and first jointer connecting portions which are provided at both end portions of the jointer body, which extend in a second direction perpendicular to the first direction, and which are configured to engage the first connecting portions, and second jointer connecting portions which are provided at both end portions of the jointer body, which extend in a third direction opposite to the second direction, and which are configured to engage the second connecting portions, wherein the first jointer connecting portions have a substantially same shape as the second connecting portions.

4. The connector set according to claim 3, wherein the second jointer connecting portions have a substantially same shape as the first connecting portions.

5. A connector set comprising:

at least one of a header and a socket; and a jointer, wherein the header comprises:

an insulating header main body; and a plurality of pairs of header contacts which are provided on the header main body and which are arranged along a first arranging direction so as to be in parallel with one another, wherein the header main body comprises first connecting portions provided at both end portions of the header main body in the first arranging direction, wherein the socket comprises:

an insulating socket main body having an insertion groove having a shape which would allow the header to be removably inserted therein; and a plurality of pairs of socket contacts which are provided on the socket main body and are arranged along a second arranging direction so as to be in parallel with one another, wherein the socket main body comprises second connecting portions provided at both end portions of the socket main body in the second arranging direction, and wherein the plurality of pairs of socket contacts are arranged to be compatible with the plurality of pairs of header contacts, wherein the jointer is configured to couple the header and the socket such that the first arranging direction of the header and the second arranging direction of the socket are in parallel with a first direction, and such that the header and the socket are oriented so as to be electrically connected to a circuit board when the header and the socket are coupled by the jointer, and wherein the jointer comprises:

a jointer body extending in the first direction, first jointer connecting portions which are provided at both end portions of the jointer body, which extend in a second direction perpendicular to the first direction, and which are configured to engage the first connecting portions, and second jointer connecting portions which are provided at both end portions of the jointer body, which extend in a third direction opposite to the second direction, and which are configured to engage the second connecting portions.

6. The connector set according to claim 5, wherein a portion of the first connecting portion, which contacts the first jointer connection portion, has a substantially same shape as a portion of the second jointer connecting portion, which contacts the second connecting portion, and wherein a portion of the second connecting portion, which contacts the second jointer connecting portion, has a substantially same shape as a portion of the first jointer connecting portion, which contacts the first connecting portion.

7. The connector set according to claim 6, wherein the second connecting portions are recess portions, and wherein the first connecting portions are protruding portions having a shape fitting to the recess portions.

8. The connector set according to claim 6, wherein one of the first jointer connecting portion and the second jointer connecting portion comprises the protruding portion having a tapered surface which becomes thinner toward a distal end thereof.

9. The connecter set according to claim 5, wherein the jointer is a resin molded article.

10. The connector set according to claim 9, wherein the socket body and the header body are made of a same insulating resin as that of the jointer.

11. The connecter set according to claim 5, wherein the jointer body has a flat surface having a given width along the second and third direction and an irregular surface opposing the flat surface.

12. A jointer for use in the connector set according to claim 5.

13. A connector set comprising:

a header which comprises:

an insulating header main body comprising first connecting portions provided at both end portions of the header main body, and a plurality of pairs of header contacts which are to contact a first circuit board and which are provided on the header main body along a first direction;

a socket which comprises:

an insulating socket main body having an insertion groove having a shape which would allow the header to be removably inserted therein, and comprising second connecting portions provided at both end portions of the socket main body, and a plurality of pairs of socket contacts which are to contact the first circuit board and which are provided on the socket main body along the first direction, such that the plurality of socket contacts are arranged to be compatible with the plurality of pairs of header contacts; and a jointer configured to couple the header and the socket such that the header and the socket are in parallel, the jointer comprising:

a jointer body, first jointer connecting portions which are provided at both end portions of the jointer body, which extend in a second direction perpendicular to the first direction, and which are configured to engage the first connecting portions, and second jointer connecting portions which are provided at both end portions of the jointer body, which extend in a third direction opposite to the second direction that is perpendicular to the first direction, and which are configured to engage the second connecting portions.

14. The connector set according to claim 13, wherein a portion of the first connecting portion, which contacts the first jointer connection portion, has a substantially same shape as a portion of the second jointer connecting portion, which contacts the second connecting portion, and wherein a portion of the second connecting portion, which contacts the second jointer connecting portion, has a substantially same shape as a portion of the first jointer connecting portion, which contacts the first connecting portion.

* * * * *